US007048313B2

(12) United States Patent
Fukunaga et al.

(10) Patent No.: US 7,048,313 B2
(45) Date of Patent: May 23, 2006

(54) LATCH MECHANISM

(75) Inventors: Katsutoshi Fukunaga, Chiryu (JP); Makoto Suzumura, Chita (JP); Shigehiro Oya, Toyoake (JP); Akira Muramatsu, Chiryu (JP); Yukinobu Kunimatsu, Toyoake (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/742,770

(22) Filed: Dec. 23, 2003

(65) Prior Publication Data

US 2004/0182122 A1 Sep. 23, 2004

(30) Foreign Application Priority Data

Dec. 24, 2002 (JP) ..... 2002-372413

(51) Int. Cl.
*E05C 3/06* (2006.01)

(52) U.S. Cl. ..... 292/216; 292/DIG. 65

(58) Field of Classification Search ..... 292/216, 292/201, DIG. 65, 337
See application file for complete search history.

(56) References Cited

U.S. PATENT DOCUMENTS 3,331,624 A * 7/1967 Pugh ..... 292/216
4,172,768 A * 10/1979 Cerdan ..... 292/216
4,775,176 A * 10/1988 Ikeda ..... 292/216
5,860,683 A * 1/1999 Sekino et al. ..... 292/216

FOREIGN PATENT DOCUMENTS

JP 8-333938 12/1996

* cited by examiner

*Primary Examiner*—Gary Estremsky
(74) *Attorney, Agent, or Firm*—Buchanan Ingersoll PC

(57) ABSTRACT

A latch mechanism includes a first base plate, a second base plate facing to the first base plate and having a first base portion, a second base portion, and a recess provided between the first base portion and the second base portion. The latch mechanism further includes a latch rotating relative to a first shaft supported by the first base plate and the first base portion and including an arm portion extending from the first base portion side toward the second base portion side when positioned in a predetermined rotating position thereof, a pawl rotating relative to a second shaft supported by the first base plate and the second base plate, and engaging with the arm portion when the latch is in the predetermined rotating position, and a connecting member connecting the first base plate with the second base plate, and provided at the second shaft side relative to a base line extending along the arm portion when the latch is in the predetermined rotating position.

4 Claims, 4 Drawing Sheets

LATCH MECHANISM

This application is based on and claims priority under 35 U.S.C. §119 with respect to Japanese Application No. 2002-372413 filed on Dec. 24, 2002, the entire content of which is incorporated herein by reference.

FIELD OF THE INVENTION

This invention generally relates to a latch mechanism. More particularly, the present invention pertains to a latch mechanism being engagable and disengagable relative to a striker.

BACKGROUND OF THE INVENTION

A known latch mechanism is disclosed in Japanese Patent Laid-Open Publication published as No. 08-333938 and shown in accompanying drawing figures FIG. 5 and FIG. 6.

In the known latch mechanism, a reinforcing shaft 92 is provided near an engaging portion at which an edge portion of a leg portion 90*a* of a latch 90 engages with a pawl portion 91*a* of a locking plate 91. When an impact load is applied in a direction of the axis of a striker 93 (in the upright direction in FIG. 5 and the upper direction in FIG. 6), the latch mechanism being in a condition as shown in FIG. 5 is deformed as follows.

Firstly, the leg portion 90*a* moves in the upper direction in FIG. 6 and engages with a cover plate 94. As a result, a certain portion of the cover plate 94 at which the leg portion 90*a* contacts deforms upheaving in the upper direction in FIG. 6. In accordance with the upheaval of the cover plate 94, the reinforcing shaft 92 deforms and leans in a direction shown with an arrow S in the right side of FIG. 6. In accordance with the deformation of the reinforcing shaft 92, the base plate 95 also deforms, as a result, a bolt 96 supporting the locking plate 91 also deforms and leans in a direction shown with an arrow S in the left side of FIG. 6. Finally, the pawl portion 91*a* of the locking plate 91 moves in the lower direction in FIG. 6. In other words, the leg portion 90*a* moves in a counter direction of the movement of the pawl portion 91*a*. Thus, the striker 93 becomes easily disengaged from the latch 90 due to a clearance generated by such deformations between the leg portion 90*a* and the pawl portion 91*a*.

The present invention therefore seeks to provide a latch mechanism wherein a striker is hardly disengaged from a latch.

SUMMARY OF THE INVENTION

According to an aspect of the present invention, a latch mechanism includes a first base plate, a second base plate facing to the first base plate and having a first base portion, a second base portion, and a recess provided between the first base portion and the second base portion.

The latch mechanism further includes a latch rotating relative to a first shaft supported by the first base plate and the first base portion and including an arm portion extending from the first base portion side toward the second base portion side when positioned in a predetermined rotating position thereof, a pawl rotating relative to a second shaft supported by the first base plate and the second base plate, and engaging with the arm portion when the latch is in the predetermined rotating position, and a connecting member connecting the first base plate with the second base plate, and provided at the second shaft side relative to a base line extending along the arm portion when the latch is in the predetermined rotating position.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements and wherein.

DETAILED DESCRIPTION OF THE INVENTION

Figure 1:
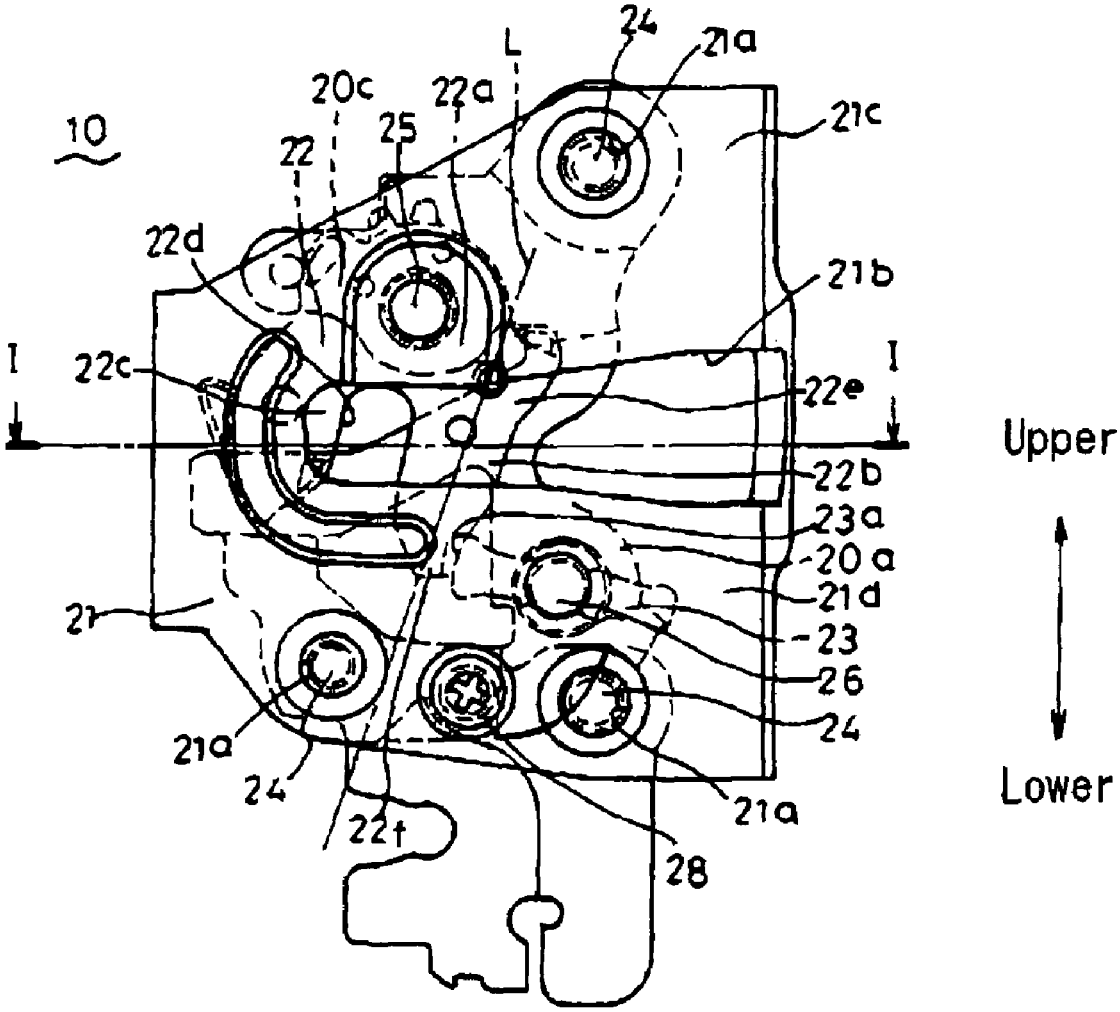
FIG. 1 illustrates a flat view of a latch mechanism according to a first embodiment of the current invention.

A preferred first embodiment of the present invention will be described hereinbelow in detail with reference to the accompanying drawings FIG. 1 through FIG. 3.

In the preferred embodiment of the current invention, a latch mechanism 10 (latch mechanism) will be explained as a part of a door lock apparatus provided at a vehicle door 11 (shown in FIG. 2); however, a configuration of a latch mechanism according to the current invention is not limited to such configuration. The latch mechanism 10 keeps the vehicle door 11 closed relative to a vehicle body 12 (shown in FIG. 3) by engaging with a striker 13 fixed at the vehicle body 12 side. FIG. 1 illustrates a flat view of the latch mechanism 10 (seen from the rear of the vehicle toward the front of the vehicle upon mounted condition to the vehicle door 11), and FIG. 2 illustrates a cross-sectional view of the latch mechanism 10 (seen from the top of the vehicle toward the bottom of the vehicle upon mounted condition to the vehicle door 11).

The latch mechanism 10 includes a base plate 20 (first base plate), a cover plate 21 (second base plate), a latch 22 (latch), a pawl 23 (pawl) and the like. The base plate 20 made of a metal plate works as a base member for holding a lever, a link and the like which forms the door lock apparatus provided within the vehicle door 11. As shown in FIG. 2, the base plate 20 is bent to form a first stepped portion 20*a*, a second stepped portion 20*b* and a third stepped portion 20*c*; however, a shape of the base plate 20 is not limited to such shape.

On the other hand, the cover plate 21 made of a metal plate is provided facing to the first stepped portion 20*a*, the second stepped portion 20*b* and the third stepped portion 20*c*. The cover plate 21 is provided along a parting panel 14 provided at the rear portion of the vehicle door 11 in longitudinal direction of the vehicle. The three holes 21*a* are formed in the cover plate 21, and the cover plate 21 is fixed to the base plate 20 by three screws 24 screwed through the parting panel 14 and the three holes 21*a*. In this way, the cover plate 21 and the base plate 20 are fixed at the vehicle door 11. A recess portion 21*b* (recess) is formed in the cover plate 21 at the center portion thereof in longitudinal direction of the vehicle (vertical direction in FIG. 2) and opening toward the vehicle room. A first base portion 21*c* (first base portion) is provided at the upper side relative to the recess portion 21*b* (at upper side in FIG. 1), and a second base portion 21*d* (second base portion) is provided lower side relative to the recess portion 21*b* (at lower side in FIG. 2). As shown in FIG. 2, the striker 13 is set within the recess portion 21*b* when the vehicle door 11 is closed relative to the vehicle body 12.

Figure 2:
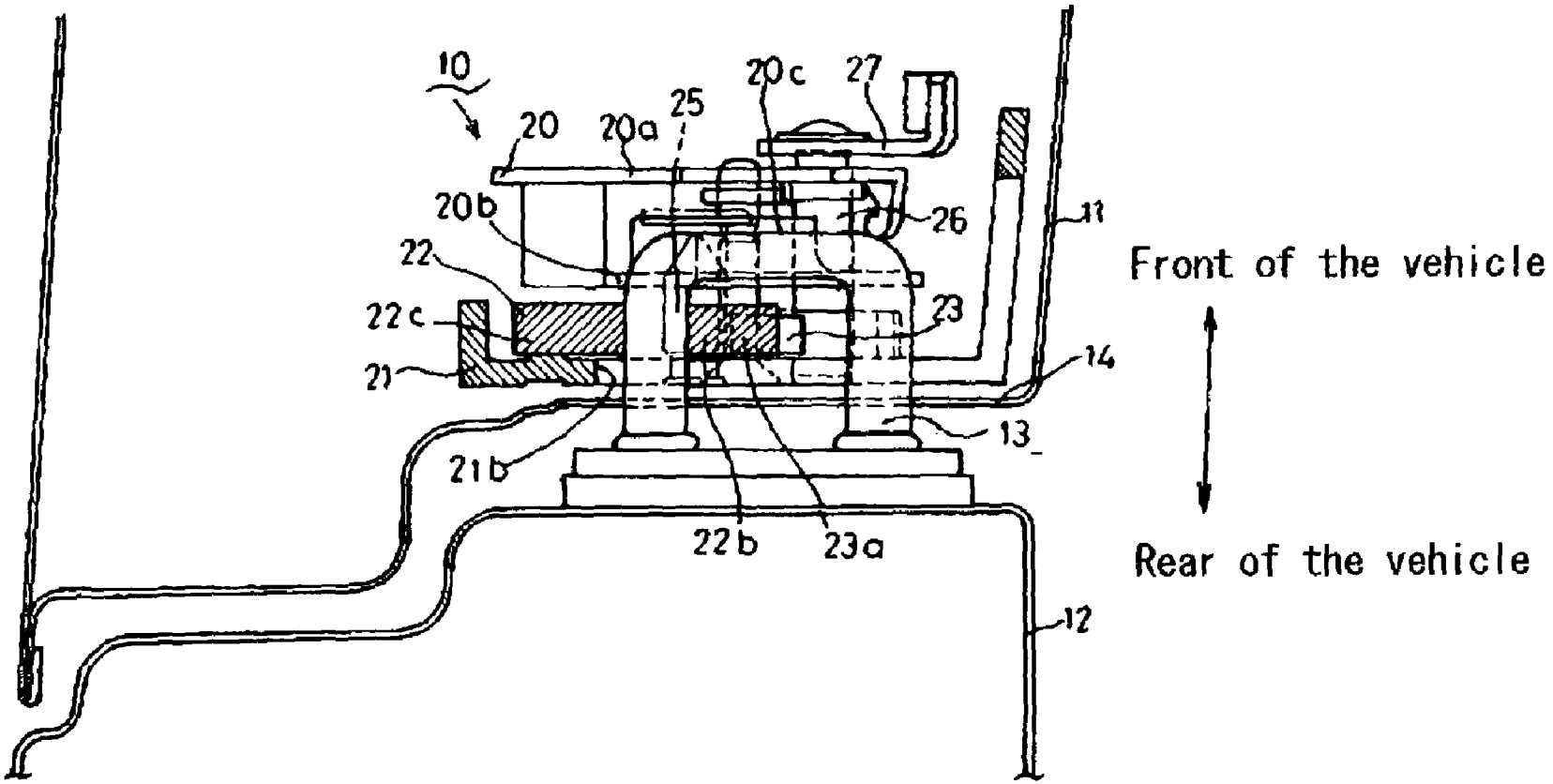
FIG. 2 illustrates a cross-sectional view of the latch mechanism according to the first embodiment of the current invention along I—I line in FIG. 1.

As shown in FIG. 2, the latch 22 is provided between the base plate 20 and the cover plate 21 and rotatably supported by a latch shaft 25 (first shaft.) A lower end of the latch shaft 25 is caulked to the first base portion 21*c* of the cover plate 21, and a top end of the latch shaft 25 in FIG. 2 is caulked to the third stepped portion 20*c* of the base plate 20. The latch shaft 25 may be fixed to the cover plate 21 and the base plate 20 in another way.

The latch 22 roughly includes a base portion 22*a* supported by the latch shaft 25 and two arm portions 22*b* and 22*c* (arm portions) extending from the base portion 22*a*. An engaging recess 22*d* is formed between the arm portion 22*b* and the arm portion 22*c*. While the latch 22 is in a releasing position, the engaging recess 22*d* is located along the recess portion 21*b* of the cover plate 21, so that the striker 13 can be inserted within the engaging recess 22*d* (this configuration is not shown). Then, the striker 13 pushes the arm portion 22*c*, as a result, the latch 22 rotates to be in the latch position hereinbelow called a predetermined rotating position) shown in FIG. 1 and FIG. 2. When the latch 22 is in the predetermined rotating position, the arm portion 22*b* of the latch 22 is engaged with the striker 13 for keeping the vehicle door 11 closed relative to the vehicle body 12. In other wards, the arm portion 22*b* includes a connecting portion 22*e* (connecting portion) integrally connecting to the base portion 22*a* and a free end portion 22*f* located on the second base portion 21*d* side of the cover plate 21 while the latch 22 is in the predetermined rotating position, so that the latch 22 cannot release the striker 13 being engaged with the latch 22 when the latch 22 is in the predetermined rotating position. In addition, a spring (not shown) is provided at the latch 22 for applying a biasing force in anticlockwise direction in FIG. 1.

As shown in FIG. 2, the pawl 23 is integrally provided between the base plate 20 and the cover plate 21 and supported rotatably relative to a pawl shaft 26 (second shaft). The pawl shaft 26 is supported by the cover plate 21 at the lower end there of in FIG. 2. The pawl shaft 26 is also supported by the first stepped portion 20*a* at the upper end thereof through a hole formed in the first stepped portion 20*a* of the base plate 20, and a lift lever 27 is caulked at the upper end of the pawl shaft 26. While the vehicle door 11 is unlocked, an operation torque is transmitted to the lift lever 27 depending on an operation of an inside door handle (not shown) and an outside door handle (not shown).

The pawl 23 includes an engaging portion 23*a* (engaging portion) engaging with the arm portion 22*b* of the latch 22 at the one end thereof. In other words, when the latch 22 is in the predetermined rotating position, the engaging portion 23*a* of the pawl 23 engages with the free end portion 22*f* of the arm portion 22*b* for stopping the rotation of the latch 22. When the pawl 23 makes a predetermined amount of rotation in anticlockwise direction in FIG. 1, the engaging portion 23*a* disengages from the free end portion 22*f*, then the latch 22 rotates in the anticlockwise direction in FIG. 1. As a result, the latch 22 rotates to be in the releasing position, thus the striker 13 disengages from the engaging recess 22*d* of the latch 22. In this way, the vehicle door 11 can be opened relative to the vehicle body 12. A spring (not shown) is provided at the pawl 23 for applying a biasing force in the clockwise direction in FIG. 1.

As shown in FIG. 1 and FIG. 2, the latch mechanism 10 includes a screw 28 (connecting member) for connecting the cover plate 21 and the base plate 20. The screw 28 is screwed into a hole in the first stepped portion 20*a* of the base plate 20 through a hole in the cover plate 21. As shown in FIG. 1, the screw 28 is provided at the pawl shaft 26 side (right in FIG. 1) relative to a base line L (base line) connecting between the connecting portion 22*e* and the free end portion 22*f* in the direction that the arm portion 22*b* extends, specifically, the screw 28 is provided between the base line L and the pawl shaft 26.

Now a deformation of the latch mechanism 10 due to an impact load applied to the striker 13 from the front of the vehicle toward the rear of the vehicle (in the downward direction in FIG. 2) when the latch mechanism 10 is in the predetermined rotating position and engaged with the striker 13 will be explained as follows.

Figure 3:
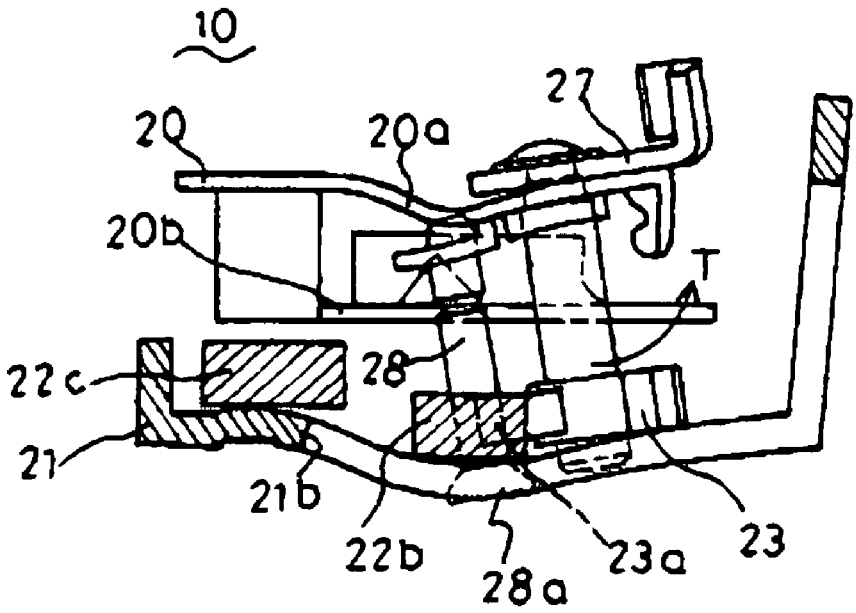
FIG. 3 illustrates a cross-sectional view of a deformed latch mechanism at which a load is applied according to the first embodiment of the current invention.

When an impact force is applied to the striker 13, the arm portion 22*b* engages with the cover plate 21, the cover plate 21 deforms upheaving in the downward direction in FIG. 3 relative to the base line L at which the arm portion 22*b* is engaged, then the arm portion 22*b* moves in the downward direction as shown in FIG. 3. A screw head 28*a* provided at the screw 28 in the side of the cover plate 21 is pulled in the downward direction in FIG. 3 along with the deformation of the cover plate 21. In addition, the first stepped portion 20*a* of the base plate 20 also deforms upheaving in the downward direction in FIG. 3 centrally at a point at which the screw 28 is screwed. According to the deformation of the cover plate 21 and the first stepped portion 20*a*, the pawl shaft 26 leans in a direction shown with an arrow T in FIG. 3. As a result, the engaging portion 23*a* of the pawl 23 moves in the lower direction in FIG. 3.

As described above, when the impact load is applied to the striker 13, the arm portion 22*b* of the latch 22 moves in the same direction as the movement of the engaging portion 23*a* of the pawl 23. Thus, the striker 13 becomes hard to disengage from the latch mechanism 10.

Figure 4:
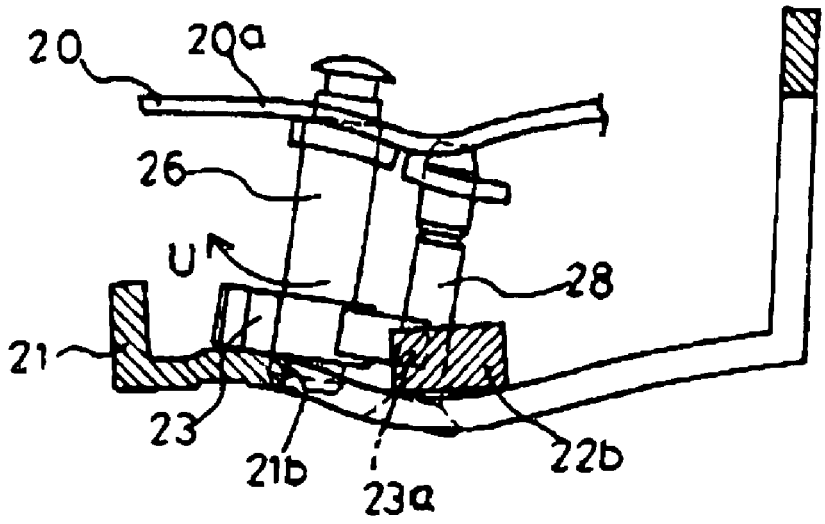
FIG. 4 illustrates a cross-sectional view of a deformed latch mechanism at which a load is applied according to the second embodiment of the current invention.
Figure 5:
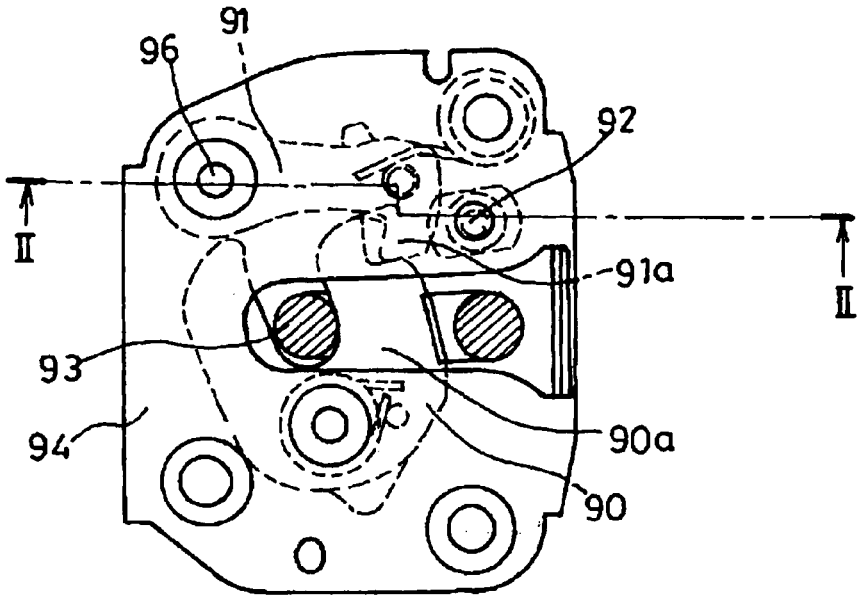
FIG. 5 Prior art
FIG. 5 illustrates a flat view of a known latch mechanism.
Figure 6:
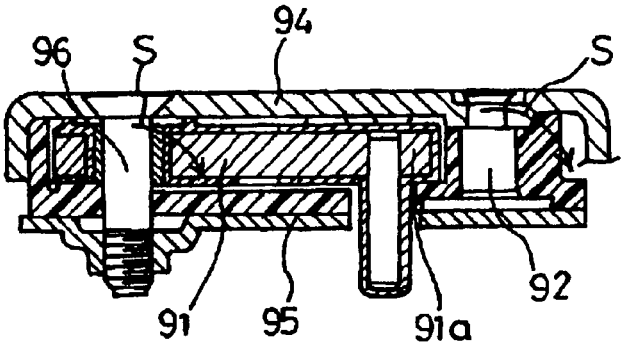
FIG. 6 Prior art
FIG. 6 illustrates a cross-sectional view of the known latch mechanism along II—II line in FIG. 6.

A second embodiment of the current invention will be described hereinbelow with reference to FIG. 4. FIG. 4 corresponds to FIG. 3 of the first embodiment of the current invention. According to the second embodiment of the current invention, the screw 28 is provided at the pawl shaft 26 side (left in FIG. 4) relative to the base line L connecting the connecting portion 22*e* and the free end portion 22*f* extending along the arm portion 22*b* in the same way as the first embodiment.

When an impact force is applied to the striker 13, the arm portion 22*b* engages with the cover plate 21, and the cover plate 12 deforms in the downward direction in FIG. 3, then the arm portion 22*b* moves in the downward direction as shown in FIG. 4. In accordance with the deformation of the cover plate 21, the screw 28 and the first stepped portion 20*a* of the base plate 20, the pawl shaft 26 leans in a direction shown with an arrow U in FIG. 4 similarly to the pawl shaft 26 in the first embodiment. As a result, the engaging portion 23*a* of the pawl 23 moves in the downward direction in FIG. 4.

Thus, the arm portion 22*b* of the latch 22 moves in the same direction as the movement of the engaging portion 23*a* of the pawl 23 when the impact load is applied to the striker 13, so that the clearance between the latch 22 and the pawl 23 is scarcely formed. In this way, the striker 13 also becomes hard to disengage from the latch mechanism 10 according to the second embodiment of the current invention.

The first embodiment and the second embodiment of the current invention can be changed as follows.

According to the first embodiment and the second embodiment, the pawl shaft 26 is supported by the second base portion 21*d* of the cover plate 21; however, the pawl shaft 26 ban be supported by the first base portion 21*c*. The pawl shaft 26 supported by the second base portion 21*d* according to the first and the second embodiment makes the pawl 23 easily to hold the latch 22 in the predetermined rotating position due to the configuration of the latch mechanism 10 that the engaging portion 23*a* engages with the arm portion 22*b* at the free end portion 22*f* being away from the latch shaft 25 relative to which the latch 22 can rotate.

According to the first embodiment and the second embodiment, the screw 28 is provided between the base line L and the pawl shaft 26, however, the pawl shaft 26 can be provided between the base line L and the screw 28. Due to the configuration of the first embodiment and the second embodiment that the screw 28 is provided closer to the base line L being a center of the deformation of the cover plate 21, the screw 28 is deformed more considerably in accordance with the deformation of the cover plate 21. Thus, the deformation of the screw 28 makes the base plate 20 to be deformed more considerably, and the deformation of the base plate 20 and the cover plate 21 lead the pawl shaft 26 to be deformed more considerably. As a result, a clearance between the latch 22 and the pawl 23 is scarcely formed.

According to the first embodiment and the second embodiment of the current invention, the cover plate 21 is connected to the base plate 20 with a screw 28; however, a metal shaft can connect the cover plate 21 with the base plate 20 by caulking at the each edge thereof.

According to the current invention, the arm portion is moved toward the second base plate to be engaged, at the same time, the engaging portion of the pawl is moved in the same direction as the movement of the arm portion, so that the clearance between the latch mechanism and the pawl is scarcely formed. As a result, the striker becomes hard to disengage from the latch mechanism.

In addition, according to the current invention, the engaging portion of the pawl engages with the free end portion provided away from the first shaft relative to which the latch rotates, thus the pawl can easily hold the latch in the predetermined rotating position.

Furthermore, according to the current invention, the deformation of the second base plate leads the connecting member to deform more considerably; in addition, the deformation of the connecting member leads the first base plate to deform more considerably. As a result, the second shaft can deforms more considerably due to the deformations of the second base plate and the first base plate.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the sprit of the present invention. Accordingly, it is expressly intended that all such variations, changes and equivalents which fall within the spirit and scope of the present invention as defined in the claims, be embraced thereby.

What is claimed is:

1. A latch mechanism comprising:

a first base plate;

a second base plate facing to the first base plate and having a slot;

a latch rotatable relative to a first shaft supported by the first base plate and the second base plate, and including an arm portion extending across the slot when the latch is in a closed position;

a pawl rotatable relative to a second shaft supported by the first base plate and the second base plate, and having an engaging portion that engages the arm portion when the latch is in the closed position; and a connecting member connecting the first base plate with the second base plate, the connecting member being provided at a side of the second shaft relative to a base line extending along the arm portion when the latch is in the closed position the connecting member being closer to the base line than the second shaft; and the connecting member including a screw provided at the second base plate, the screw member being screwed into the first base plate.

2. A latch mechanism according to claim 1, wherein the connecting member is provided between the base line and the second shaft.

3. A latch mechanism according to claim 1, wherein the latch holds a striker when the latch is in the closed position.

4. A latch mechanism according to claim 3, wherein the connecting member is provided between the base line and the second shaft.

* * * * *